US010537212B1

(12) United States Patent
Lee

(10) Patent No.: US 10,537,212 B1
(45) Date of Patent: Jan. 21, 2020

(54) DISPENSER FOR COIN TISSUE

(71) Applicant: CLEANZONE CO., LTD., Pocheon-si, Gyeonggi-do (KR)

(72) Inventor: Wan Gu Lee, Seoul (KR)

(73) Assignee: CLEANZONE CO., LTD., Pocheon-si, Gyeonggi (KR)

( * ) Notice: Subject to any disclaimer, the term of this patent is extended or adjusted under 35 U.S.C. 154(b) by 0 days.

(21) Appl. No.: 16/259,413

(22) Filed: Jan. 28, 2019

(30) Foreign Application Priority Data

Sep. 7, 2018 (KR) ..... 10-2018-0107265

(51) Int. Cl.
*A47K 10/42* (2006.01)
*A47K 10/32* (2006.01)

(52) U.S. Cl.
CPC .... *A47K 10/421* (2013.01); *A47K 2010/3233* (2013.01); *A47K 2010/3273* (2013.01)

(58) Field of Classification Search
CPC ..... A47K 10/426; A47K 2010/328; A47K 2010/3286
See application file for complete search history.

(56) References Cited

U.S. PATENT DOCUMENTS 3,749,313 A * 7/1973 Weitmann ..... B05B 3/085 239/127
4,051,977 A * 10/1977 Steinfeld ..... B65D 81/3216 221/96
4,667,846 A * 5/1987 Marceau ..... A47K 10/32 221/34
5,044,556 A * 9/1991 Suzuki ..... A47K 10/32 222/183
5,443,084 A * 8/1995 Saleur ..... A47K 10/32 134/122 R
5,887,759 A * 3/1999 Ayigbe ..... A47K 10/32 222/192
7,856,941 B2 * 12/2010 Nelson ..... A47K 10/32 118/301
2002/0121454 A1 * 9/2002 Ross ..... A61J 1/03 206/539
2010/0051576 A1 * 3/2010 Tran ..... B65D 51/185 215/386
2010/0078444 A1 * 4/2010 Shannon ..... B65D 21/086 221/63
2012/0181297 A1 * 7/2012 Cofrancesco ..... A47K 10/38 221/26
2012/0223092 A1 * 9/2012 Hallam ..... B65D 83/0805 221/282

(Continued)

*Primary Examiner* — Gene O Crawford
*Assistant Examiner* — Ayodeji T Ojofeitimi
(74) *Attorney, Agent, or Firm* — Knobbe Martens Olson & Bear LLP

(57) ABSTRACT

Provided is a dispenser for coin tissue that can hygienically keep coin tissues and is easy to use. The dispenser for coin tissue includes a housing and a coin tissue accommodation portion provided in the housing and accommodating a plurality of coin tissues. The dispenser also includes a water accommodation portion provided in the housing and accommodating water and a tissue supply waiting portion provided in an upper portion of the housing and in which at least one of the plurality of coin tissues waits. The dispenser further includes a water supply portion provided in the housing and supplying the water to the tissue supply waiting portion.

12 Claims, 4 Drawing Sheets

(56) References Cited

U.S. PATENT DOCUMENTS

| | | | | |
|---|---|---|---|---|
| 2012/0223093 | A1* | 9/2012 | Hallam | B65D 77/042 221/46 |
| 2012/0248136 | A1* | 10/2012 | Meyers | A61L 2/22 221/96 |
| 2013/0119083 | A1* | 5/2013 | Ophardt | A47K 5/1204 222/64 |
| 2015/0272404 | A1* | 10/2015 | Jeon | A47K 10/32 222/173 |
| 2015/0289731 | A1* | 10/2015 | Lee | A47K 10/426 221/45 |
| 2016/0121350 | A1* | 5/2016 | Yeung | A47K 5/1207 222/1 |

* cited by examiner

DISPENSER FOR COIN TISSUE

CROSS-REFERENCE TO RELATED APPLICATION

This application claims the benefit of Korean Patent Application No. 10-2018-0107265, filed on Sep. 7, 2018, in the Korean Intellectual Property Office, the disclosure of which is incorporated herein in its entirety by reference.

BACKGROUND

1. Field

One or more embodiments relate to dispensers for coin tissue.

2. Description of the Related Technology

In general, coin tissues are compressed into a coin shape and kept in a state where moisture is removed. When water is poured into a coin tissue, the coin tissue expands like general water tissue, which has been widely used in restaurants.

In particular, since coin tissues are compressed and dried without water, there is no concern about reproduction of germs and also there is no need to use separate preservatives such as antifungals or antioxidants.

Coin tissues according to the related art are provided such that several coin tissues are kept in a sealed plastic or zipper bag for hygienic management. Therefore, in order to use coin tissues, the coin tissues are taken out one by one from the plastic or zipper bag.

However, the coin tissues according to the related art have a problem in that, whenever a plastic or zipper bag is opened for use, moisture in the air continuously flows into the plastic or zipper bag, and further the coin tissue contacts a user's hand. As a result, whenever the coin tissue is used, hygienic management is weakened by the user's hand as well as the inflow of moisture.

Furthermore, since a separate device and water are necessary, it is inconvenient to use the coin tissues according to the related art.

SUMMARY

One or more embodiments include dispensers for coin tissue which may hygienically keep coin tissues and may be easy to use and carry.

Additional aspects will be set forth in part in the description which follows and, in part, will be apparent from the description, or may be learned by practice of the presented embodiments.

According to one or more embodiments, a dispenser for coin tissue comprises a housing; a coin tissue accommodation portion provided in the housing and accommodating a plurality of coin tissues; a water accommodation portion provided in the housing and accommodating water; a tissue supply waiting portion provided in an upper portion of the housing and in which at least one of the plurality of coin tissues waits; and a water supply portion provided in the housing and supplying the water to the tissue supply waiting portion.

The housing may comprise a center partition provided vertically at a center of the inside of the housing, and the coin tissue accommodation portion and the water accommodation portion are provided parallel to each other at left and right sides of the inside of the housing with the center partition therebetween.

The water supply portion may comprise a water supply path provided in the center partition and comprising one end communicating with a lower portion of the water accommodation portion and another end communicating with the tissue supply waiting portion; and a pumping portion provided in an upper portion of the water accommodation portion and pumping the water in the water accommodation portion to flow toward the tissue supply waiting portion via the water supply path.

The pumping portion may comprise a press button provided on an upper inner circumferential surface of the water accommodation portion to be capable of moving up and down; a support step formed on an inner circumferential surface of the water accommodation portion; and an elastic body provided between the press button and the support step and applying a force upwardly to the press button to allow the press button to return to an original position.

The pumping portion further may comprise a sealing member provided between the press button and the inner circumferential surface of the water accommodation portion.

The tissue supply waiting portion is provided at a position corresponding to an upper portion of the coin tissue accommodation portion, the tissue supply waiting portion may comprise a tissue waiting recess comprising an upper open portion; and a tissue waiting recess cover opening and closing the upper open portion.

The coin tissue accommodation portion may comprise a tissue accommodation space formed at the left side of the inside of the housing and having a lower left open portion; and a tissue accommodation space cover opening and closing the lower left open portion.

The water accommodation portion may comprise a water accommodation space formed at the right side of the inside of the housing and having a lower right open portion; and a water accommodation space cover opening and closing the lower right open portion.

The housing may have a width that is greater in a left to right direction than in a front to rear direction.

According to one or more embodiments, a dispenser for coin tissue comprises a housing; a water accommodation portion provided in the housing and accommodating water; a tissue supply waiting portion provided in the housing and in which a coin tissue waits, the coin tissue expanding when receiving the water supplied by the water accommodation portion; and a water supply portion provided in the housing and supplying the water to the tissue supply waiting portion.

The housing may comprise a coin tissue accommodation portion, separate from the tissue supply waiting portion, accommodating a plurality of coin tissues to be supplied to the tissue supply waiting portion.

The water accommodation portion and the tissue supply waiting portion may be partitioned by a center partition provided in the housing, and the water supply portion may comprise a water supply path provided in the center partition and communicating the water accommodation portion with the tissue supply waiting portion; and a pumping portion pumping the water in the water accommodation portion to flow toward the tissue supply waiting portion via the water supply path.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION

Figure 1:
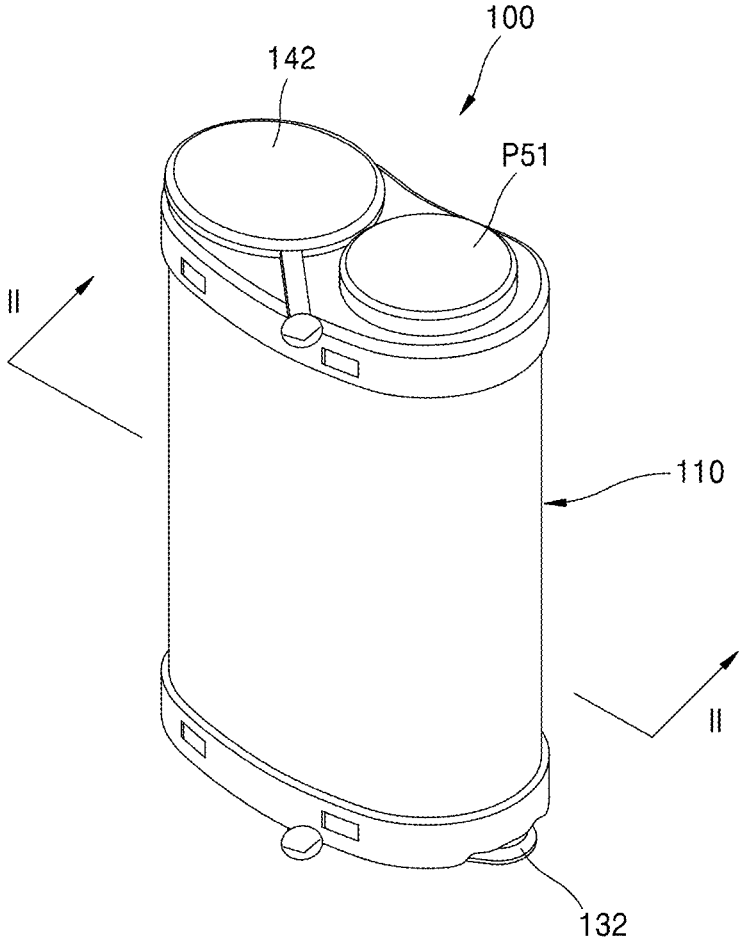
FIG. 1 is a perspective view schematically illustrating a dispenser for coin tissue according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 2:
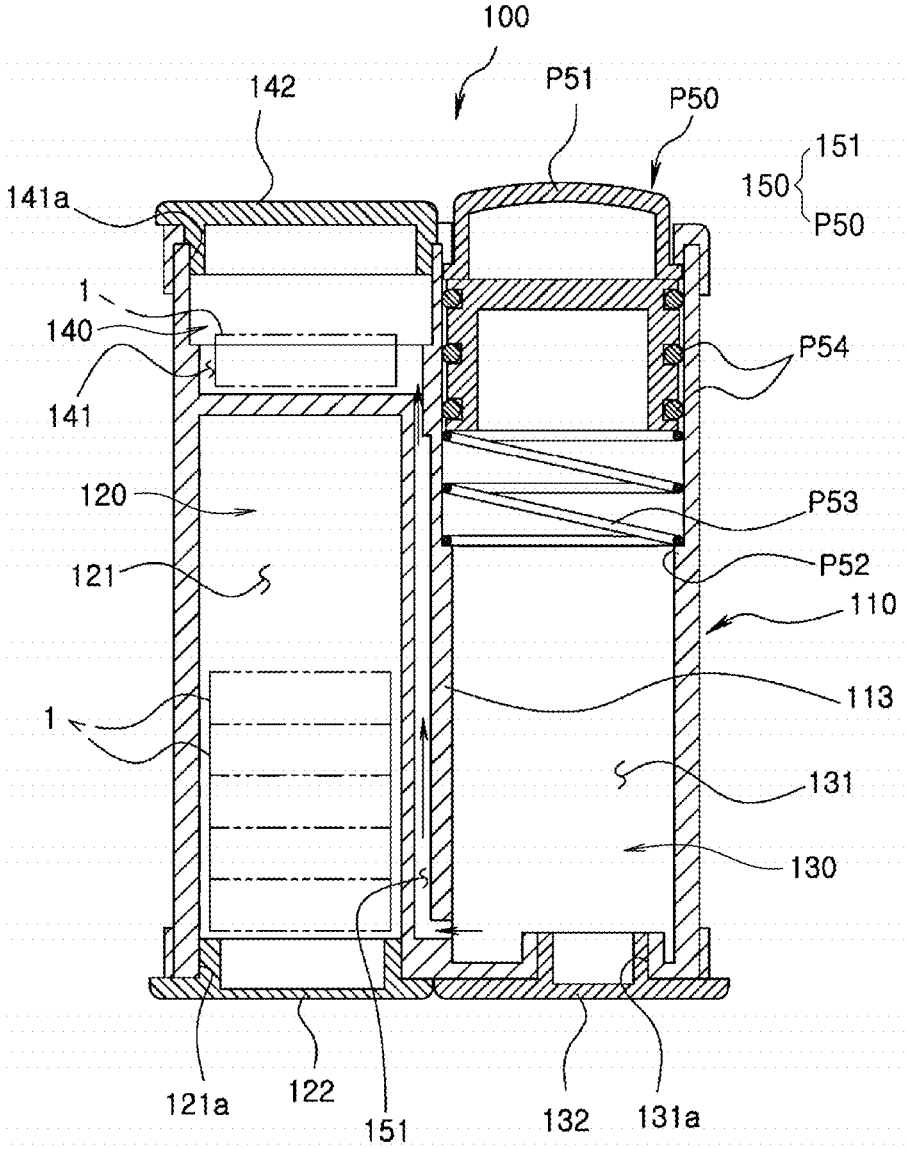
FIG. 2 is a schematic cross-sectional view of the dispenser for coin tissue of FIG. 1, taken along line II-II of FIG. 1.
Figure 3:
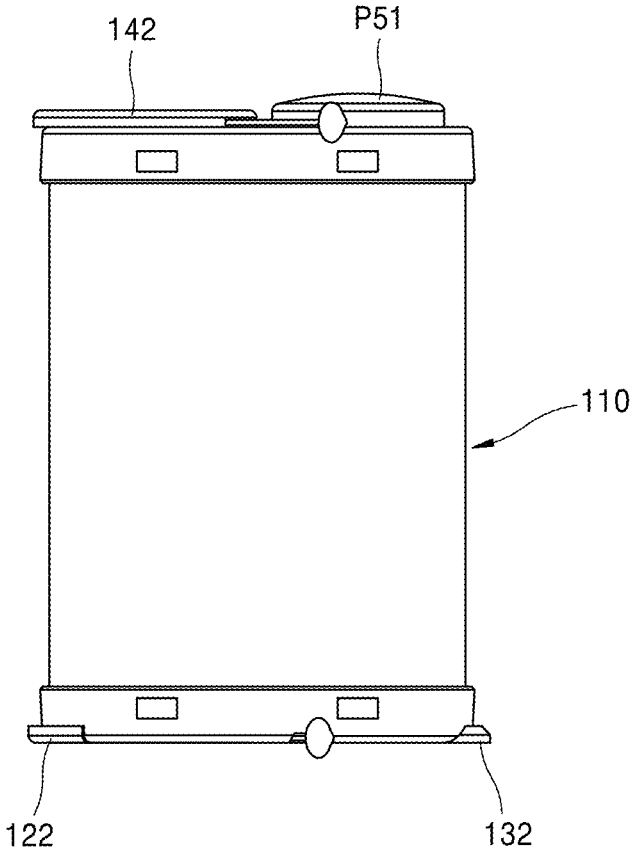
FIG. 3 is a front side view of the dispenser for coin tissue of FIG. 1.
Figure 4:
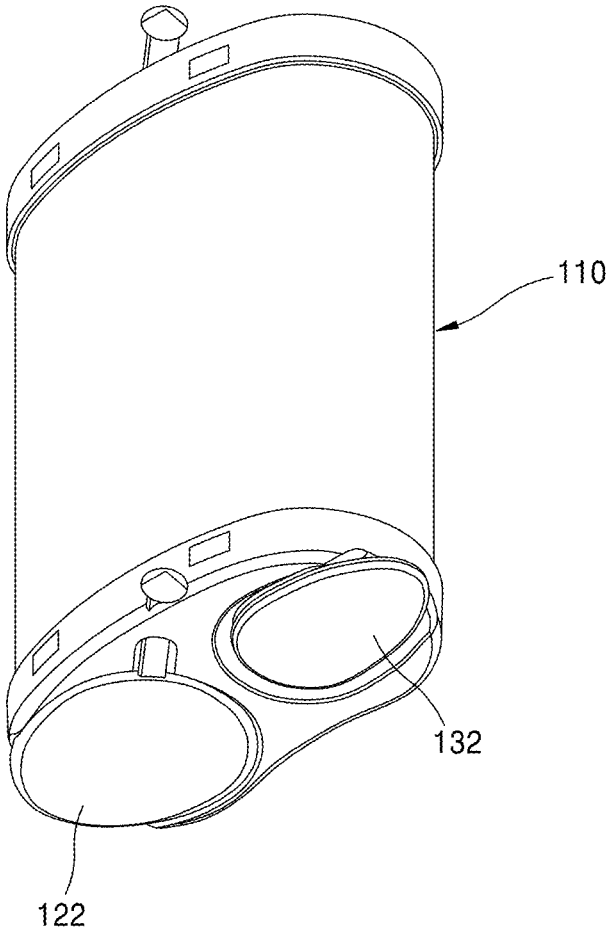
FIG. 4 is a bottom perspective view of the dispenser for coin tissue of FIG. 1.

FIG. 1 is a perspective view schematically illustrating a dispenser for coin tissue according to an embodiment. FIG. 2 is a schematic cross-sectional view of the dispenser for coin tissue of FIG. 1, taken along line II-II of FIG. 1. FIG. 3 is a front side view of the dispenser for coin tissue of FIG. 1. FIG. 4 is a bottom perspective view of the dispenser for coin tissue of FIG. 1.

A dispenser 100 for coin tissue according to an embodiment may include, as illustrated in FIGS. 1 to 4, a housing 110, a coil tissue accommodation portion 120, a water accommodation portion 130, a tissue supply waiting portion 140, and a water supply portion 150. The respective constituent elements are described below in detail with reference to FIGS. 1 to 4.

The housing 110, as illustrated in FIGS. 1 and 2, forms an overall shape of the dispenser 100 for coin tissue according to the present embodiment. The housing 110, as illustrated in FIG. 2, may include a center partition 113 provided in a vertical direction at the center of the inside of the housing 110.

Furthermore, as illustrated in FIGS. 1 and 4, the housing 110 may have a width that is greater in a left to right direction than in a front to rear direction.

The coin tissue accommodation portion 120, as illustrated in FIG. 2, accommodates a plurality of coin tissues 1. The coin tissue accommodation portion 120, as illustrated in FIG. 2, may be provided at the left side of the inside of the housing 110 with the center partition 113 therebetween.

For example, the coin tissue accommodation portion 120, as illustrated in FIGS. 2 and 4, may include a tissue accommodation space 121 and a tissue accommodation space cover 122. The tissue accommodation space 121 may be formed at the left side of the inside of the housing 110 and may include a lower left open portion 121*a*. The tissue accommodation space cover 122 may open or close the lower left open portion 121*a*.

Accordingly, when the coin tissues 1 are to be used, a user opens the tissue accommodation space cover 122 and takes out one of the coin tissues 1 located at the lowest side of a plurality of coin tissues from the tissue accommodation space 121 and moves the coin tissue 1 to the tissue supply waiting portion 140. Furthermore, the tissue accommodation space cover 122 may block external foreign materials from intruding into the tissue accommodation space 121.

The water accommodation portion 130 accommodates water. The water accommodation portion 130, as illustrated in FIG. 2, may be provided at the right side of the inside of the housing 110 with the center partition 113 therebetween. Furthermore, the water accommodation portion 130, as illustrated in FIG. 2, may be provided parallel to the coin tissue accommodation portion 120 with the center partition 113 therebetween. Furthermore, the water accommodation portion 130 may have a shape approximately left and right symmetrical to the coin tissue accommodation portion 120 with respect to the center partition 113.

For example, the water accommodation portion 130, as illustrated in FIGS. 2 and 4, may include a water accommodation space 131 and a water accommodation space cover 132. The water accommodation space 131 may be formed at the right side of the inside of the housing 110 and may include a lower right open portion 131*a*. The water accommodation space cover 132 may open or close the lower right open portion 131*a*.

Accordingly, when water in the water accommodation space 131 is insufficient, the user may open the water accommodation space cover 132 to add external water to the water accommodation space 131.

The tissue supply waiting portion 140 is used as a waiting place for the coin tissues 1 to be used. The tissue supply waiting portion 140, as illustrated in FIG. 2, may be provided in the upper portion of the housing 110, in which one or more of the coin tissues 1 (or one coin tissue) taken out from the coin tissue accommodation portion 120 may wait for use.

Furthermore, the tissue supply waiting portion 140, as illustrated in FIG. 2, may be provided in the upper portion of the housing 110 at a position corresponding to the top end of the coin tissue accommodation portion 120.

For example, the tissue supply waiting portion 140, as illustrated in FIGS. 1 and 2, may include a tissue waiting recess 141 and a tissue waiting recess cover 142. The tissue waiting recess 141 may be provided in the upper portion of the housing 110 and may include an upper open portion 141*a*. The tissue waiting recess cover 142 may open or close the upper open portion 141*a*.

Accordingly, the coin tissue waiting in the tissue waiting recess 141 may be changed to water tissue by receiving water from the water supply portion 150 that is described later. Furthermore, the tissue waiting recess cover 142 may block the intrusion of external foreign materials into the tissue waiting recess 141 and the outflow of the water flowing into the tissue waiting recess 141. In particular, since the outflow of water is blocked by the tissue waiting recess cover 142, the water accommodation space cover 132, and a sealing member P54 that is described later, the user may safely carry the dispenser 100 for coin tissue according to the present embodiment in a bag.

The water supply portion 150 supplies water to the tissue supply waiting portion 140. The water supply portion 150, as illustrated in FIG. 2, may be provided in the housing 110.

For example, the water supply portion 150, as illustrated in FIG. 2, may include a water supply path 151 and a pumping portion P50. The water supply path 151 may be provided in the center partition 113 and may have one end communicating with a lower portion of the water accommodation portion 130 and the other end communicating with the tissue supply waiting portion 140. The pumping portion P50 may be provided in an upper portion of the water accommodation portion 130 and may pump the water in the water accommodation portion 130 to flow toward the tissue supply waiting portion 140 via the water supply path 151 (see an arrow in FIG. 2).

In detail, the pumping portion P50, as illustrated in FIGS. 1 and 2, may include a press button P51, a support step P52, and an elastic body P53. The press button P51 may be provided on an upper inner circumferential surface of the water accommodation portion 130 to be capable of moving up and down. The support step P52 may =be formed on an inner circumferential surface of the water accommodation portion 130. The elastic body P53 may be provided between the press button P51 and the support step P52 to apply a force upwardly to the press button P51 so that the press button P51 may return to the original position.

Furthermore, the pumping portion P50, as illustrated in FIG. 2, may further include the sealing member P54, such as an O-ring, between the press button P51 and the inner circumferential surface of the water accommodation portion 130.

As described above, the dispenser 100 for coin tissue according to the present embodiment has the following effect.

According to the present embodiment, since the housing 110, the coil tissue accommodation portion 120, the water accommodation portion 130, the tissue supply waiting portion 140, and the water supply portion 150 are provided, the coin tissue accommodation portion 120 may accommodate the coin tissues 1 and, when necessary, the coin tissues 1 may be placed one by one in the tissue supply waiting portion 140 for use. Accordingly, the coin tissues 1 may be hygienically kept and also the water in the water accommodation portion 130 may be supplied to the coin tissue placed in the tissue supply waiting portion 140 by means of the water supply portion 150. Thus, a separate water supply device such as a kettle is not needed, and thus the dispenser may be conveniently used and carried.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A dispenser for coin tissue comprising:

a housing;

a coin tissue accommodation portion provided in the housing and accommodating a plurality of coin tissues;

a water accommodation portion provided in the housing and accommodating water;

a tissue supply waiting portion provided in an upper portion of the housing and in which at least one of the plurality of coin tissues waits; and a water supply portion provided in the housing and configured to supply the water to the tissue supply waiting portion.

2. The dispenser for coin tissue of claim 1, wherein the housing has a width that is greater in a left to right direction than in a front to rear direction.

3. The dispenser for coin tissue of claim 1, wherein the water accommodation portion comprises:

a water accommodation space formed at the right side of the inside of the housing and having a lower right open portion; and a water accommodation space cover configured to open and close the lower right open portion.

4. The dispenser for coin tissue of claim 1, wherein the coin tissue accommodation portion comprises:

a tissue accommodation space formed at the left side of the inside of the housing and having a lower left open portion; and a tissue accommodation space cover configured to open and close the lower left open portion.

5. The dispenser for coin tissue of claim 1, wherein the tissue supply waiting portion is provided at a position corresponding to an upper portion of the coin tissue accommodation portion, the tissue supply waiting portion comprising:

a tissue waiting recess comprising an upper open portion; and a tissue waiting recess cover configured to open and close the upper open portion.

6. The dispenser for coin tissue of claim 1, wherein the housing comprises a center partition provided vertically at a center of the inside of the housing, and the coin tissue accommodation portion and the water accommodation portion are provided parallel to each other at left and right sides of the inside of the housing with the center partition therebetween.

7. The dispenser for coin tissue of claim 6, wherein the water supply portion comprises:

a water supply path provided in the center partition and comprising one end communicating with a lower portion of the water accommodation portion and another end communicating with the tissue supply waiting portion; and a pumping portion provided in an upper portion of the water accommodation portion and configured to pump the water in the water accommodation portion to flow toward the tissue supply waiting portion via the water supply path.

8. The dispenser for coin tissue of claim 7, wherein the pumping portion comprises:

a press button provided on an upper inner circumferential surface of the water accommodation portion configured to move up and down;

a support step formed on an inner circumferential surface of the water accommodation portion; and an elastic body provided between the press button and the support step and configured to apply a force upwardly to the press button to allow the press button to return to an original position.

9. The dispenser for coin tissue of claim 8, wherein the pumping portion further comprises a sealing member provided between the press button and the inner circumferential surface of the water accommodation portion.

10. A dispenser for coin tissue comprising:

a housing;

a water accommodation portion provided in the housing and accommodating water;

a tissue supply waiting portion provided in the housing and in which a coin tissue waits, the coin tissue configured to expand when receiving the water supplied by the water accommodation portion; and a water supply portion provided in the housing and configured to supply the water to the tissue supply waiting portion.

11. The dispenser for coin tissue of claim 10, wherein the housing comprises a coin tissue accommodation portion, separate from the tissue supply waiting portion, accommodating a plurality of coin tissues to be supplied to the tissue supply waiting portion.

12. The dispenser for coin tissue of claim 10, wherein the water accommodation portion and the tissue supply waiting portion are partitioned by a center partition provided in the housing, and the water supply portion comprises a water supply path provided in the center partition and communicating the water accommodation portion with the tissue supply waiting portion; and a pumping portion configured to pump the water in the water accommodation portion to flow toward the tissue supply waiting portion via the water supply path.

* * * * *